US012102181B1

(12) United States Patent
Dong

(10) Patent No.: US 12,102,181 B1
(45) Date of Patent: Oct. 1, 2024

(54) HEATING SHOE

(71) Applicant: Dongguan Like Electric Heating Technology Co., Ltd, Dongguan (CN)

(72) Inventor: Liang Dong, Dongguan (CN)

(73) Assignee: Dongguan Like Electric Heating Technology Co., Ltd, Dongguan (CN)

( * ) Notice: Subject to any disclaimer, the term of this patent is extended or adjusted under 35 U.S.C. 154(b) by 0 days.

(21) Appl. No.: 18/597,819

(22) Filed: Mar. 6, 2024

(51) Int. Cl.

| | |
|---|---|
| ***A43B 3/35*** | (2022.01) |
| ***A43B 3/44*** | (2022.01) |
| *A43B 3/40* | (2022.01) |
| *A43B 3/48* | (2022.01) |
| *A43B 7/08* | (2022.01) |

(52) U.S. Cl.
CPC ..... *A43B 3/35* (2022.01); *A43B 3/44* (2022.01); *A43B 3/40* (2022.01); *A43B 3/48* (2022.01); *A43B 7/08* (2013.01)

(58) Field of Classification Search
CPC .... A43B 7/02; A43B 3/35; A43B 3/44; A43B 3/48; A43B 3/355
USPC ..... 36/2.6
See application file for complete search history.

(56) References Cited

U.S. PATENT DOCUMENTS

| | | | | |
|---|---|---|---|---|
| 9,386,819 | B2 * | 7/2016 | Hakkala | A43B 17/00 |
| 2009/0113762 | A1 * | 5/2009 | Leimer | A43B 7/081 36/3 R |
| 2011/0107771 | A1 * | 5/2011 | Crist | A43B 3/355 36/83 |
| 2012/0159811 | A1 * | 6/2012 | Whitehead | A43B 3/38 36/43 |
| 2012/0311885 | A1 * | 12/2012 | Moreshead | A41D 31/12 36/2.6 |
| 2013/0019503 | A1 * | 1/2013 | Vogt | A43B 7/081 320/108 |
| 2014/0182162 | A1 * | 7/2014 | Hakkala | A43B 7/02 36/43 |
| 2018/0317597 | A1 * | 11/2018 | Maxey | H05B 3/34 |

FOREIGN PATENT DOCUMENTS

| | | |
|---|---|---|
| CN | 206612279 U | 11/2017 |
| CN | 210203527 U | 3/2020 |
| CN | 210299720 U | 4/2020 |

* cited by examiner

*Primary Examiner* — Timothy K Trieu
(74) *Attorney, Agent, or Firm* — Birchwood IP

(57) ABSTRACT

The present invention discloses a heating shoe, including a sole and a vamp, where the vamp is arranged on the sole; the heating shoe further includes a power supply device, a heating device, and a control device, where an upper surface of the sole is provided with several heating zones, the heating device is electrically connected to the control device, the control device is electrically connected to the power supply device, and the control device is mounted on an outer surface of the vamp; a heating module is arranged on the upper surface of the sole; the heating module includes a plurality of groups of heating elements; a control module independently controls each of the plurality of groups of heating elements; and each of the plurality of groups of heating elements is arranged respectively corresponding to a different one of the heating zones.

8 Claims, 4 Drawing Sheets

HEATING SHOE

TECHNICAL FIELD

The present invention relates to the field of thermal shoes, and in particular, to a heating shoe.

BACKGROUND

A heating shoe is not only an improved shoe but also a new invention that improves a traditional product with a new technology. Most commercially available shoes require two external power supplies respectively bound on left and right legs, and the control buttons thereof are integrated on batteries. If the temperature is required to be adjusted uniformly, it is necessary to adjust both left and right shoes, and a section of electrical wire may be provided. The electrical wire is prone to damage and also inconvenient for movement.

Existing commercially available heating shoes in the prior art can only control the overall temperature and cannot realize temperature zoning, resulting in that a zone requiring no heating is heated excessively, and it is uncomfortable for a user to wear.

SUMMARY

A technical problem to be solved by the present invention is to provide a heating shoe capable of temperature zoning control, which is convenient and comfortable to use.

An objective of the present invention is achieved by the following technical solution:

a heating shoe, including a sole and a vamp, where the vamp is arranged on the sole; the heating shoe further includes a power supply device, a heating device, and a control device, where an upper surface of the sole is provided with several heating zones, the heating device is electrically connected to the control device, the control device is electrically connected to the power supply device, and the control device is mounted on an outer surface of the vamp; a heating module is arranged on the upper surface of the sole; the heating module includes a plurality of groups of heating elements; a control module independently controls each of the plurality of groups of heating elements; and each of the plurality of groups of heating elements is arranged respectively corresponding to a different one of the heating zones.

Further, the heating device includes a heating sheet and a first terminal connected to the heating sheet; the control module includes a second terminal quickly detachably connected to the first terminal; the heating sheet includes a fixed layer and a waterproof layer; the heating elements are arranged between the fixed layer and the waterproof layer; and the heating sheet covers the upper surface of the sole.

Further, the power supply device includes a charging power supply and a third terminal connected to the charging power supply; the control module includes a fourth terminal quickly detachably connected to the third terminal; a first groove is formed at a heel position of the sole; and the charging power supply is arranged in the first groove.

Further, the charging power supply includes a battery case and a lithium polymer battery; and a thimble and/or an induction coil for charging the lithium polymer battery are/is arranged on the battery case.

Further, the control device includes a control panel and a temperature control module; the temperature control module includes a temperature control circuit and a temperature control switch arranged on the control panel; the temperature control circuit is electrically connected to the heating elements; and the temperature control switch independently controls the heating temperature of each of the plurality of groups of heating elements.

Further, the control device includes a shoe-off power-off module; and the shoe-off power-off module includes a sensor for sensing whether a foot is removed from a shoe cavity of the heating shoe, and a power-off control circuit cooperating with the sensor.

Further, the control device includes a delayed drying module; the delayed drying module includes a drying switch and a delayed drying circuit cooperating with the sensor; and the drying switch is arranged on the control panel.

Further, the heating shoe further includes a hot air device; the vamp includes a tongue; the control panel and the hot air device are detachably arranged on the tongue; and the insole is provided with several vent holes corresponding to acupuncture points on a foot sole.

Further, the heating elements include a heating wire made of stainless steel fiber.

Another objective of the present invention is to provide a heating shoe set, including two of the above-described heating shoes; the control device includes a communication module; the communication module includes any one of an infrared unit, a Bluetooth unit, a Wi-Fi unit, a radio frequency identification unit, and a 3G/4G/5G mobile communication unit, or a combination thereof; the two heating shoes perform wireless communication through the communication module; the heating shoe set further includes a charging shoe rack; the charging shoe rack includes a charging base and a storage rack; and when the heating shoe is placed on the storage rack, the charging base cooperates with the power supply device for charging.

According to the present invention, the plurality of groups of heating elements are arranged in the heating shoe, and each of the plurality of groups of heating elements is arranged respectively corresponding to a different one of the heating zones so that temperature zoning can be realized; the control module independently controls each of the plurality of groups of heating elements so that a certain zone of the sole that is required to be heated separately can generate heat separately or a certain zone has a heating temperature different from those of other zones as required, which can save electricity and prolong the battery life while meeting more requirements. Furthermore, the control device is arranged on the outer surface of the vamp, which is very convenient for a user to operate and use.

Reference signs: 10. heating shoe; 11. sole; 111. first groove; 112. second groove; 12. vamp; 121. tongue; 13. insole; 131. vent hole; 20. power supply device; 21. charging power supply; 22. third terminal; 30. heating device; 31. heating sheet; 311. fixed layer; 312. heating element; 313. waterproof layer; 32. first terminal; 40. control device; 41. control panel; 42. temperature control module; 43. temperature control switch; 44. second terminal; 45. fourth terminal; 46. shoe-off power-off module; 47. delayed drying module; 48. communication module.

DETAILED DESCRIPTION OF THE EMBODIMENTS

In the description of the present invention, it should be understood that the orientations or positional relationships indicated by the terms "center", "transverse", "upper", "lower", "left", "right", "vertical", "horizontal", "top", "bottom", "inside", "outside", and the like are based on those shown in the accompanying drawings, intended only for the convenience of describing the present invention and simplifying the description rather than for indicating or implying that the referred devices or elements must be provided with a particular orientation or constructed or operated in a particular orientation; therefore, these terms should not be construed as limiting the present invention. Furthermore, the terms "first" and "second" are intended only for descriptive purposes and should not be construed as indicating or implying their relative importance or implying the quantity of technical features indicated. Therefore, features defined by "first" and "second" may explicitly or implicitly include one or more of these features.

In the description of the present invention, unless otherwise specified, "a plurality of" refers to two or more. In addition, the terms "include" and any variant thereof are intended to cover non-exclusive inclusions.

In the description of the present invention, it should be noted that, unless otherwise explicitly provided and limited, the terms "mounted", "connected", and "connection" should be understood in a broad sense, e.g., it may be a fixed connection, a detachable connection, or an integral connection; it may be a mechanical connection or an electrical connection; it may be a direct connection or an indirect connection through an intermediate medium; and it may be a connection between two elements. For those of ordinary skill in the art, the specific meanings of the above terms in the present invention can be understood on a case-by-case basis.

The present invention is further described below with reference to the accompanying drawings and preferred embodiments.

Figure 1:
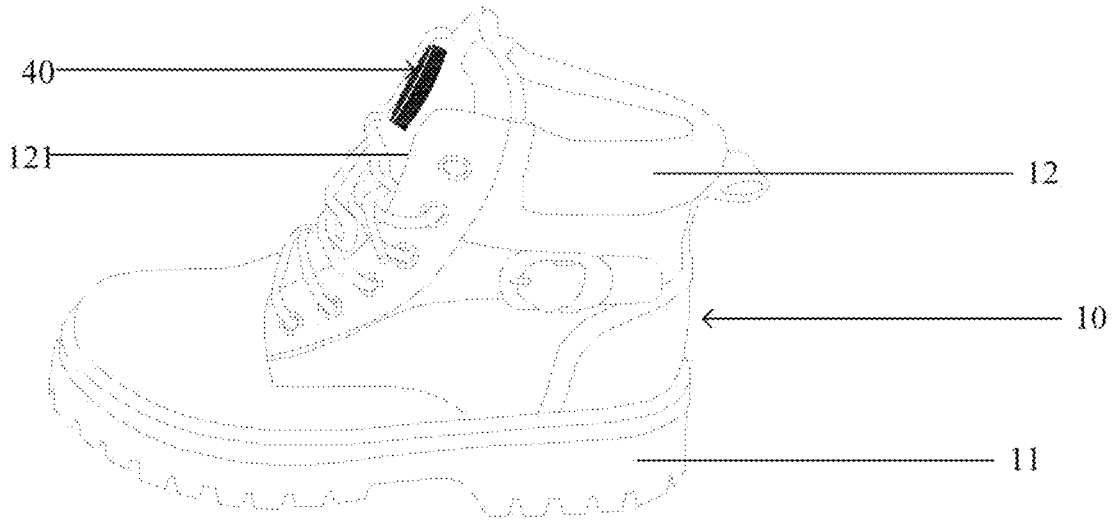
FIG. 1 is a schematic structural diagram of a heating shoe according to an embodiment of the present invention.
Figure 2:
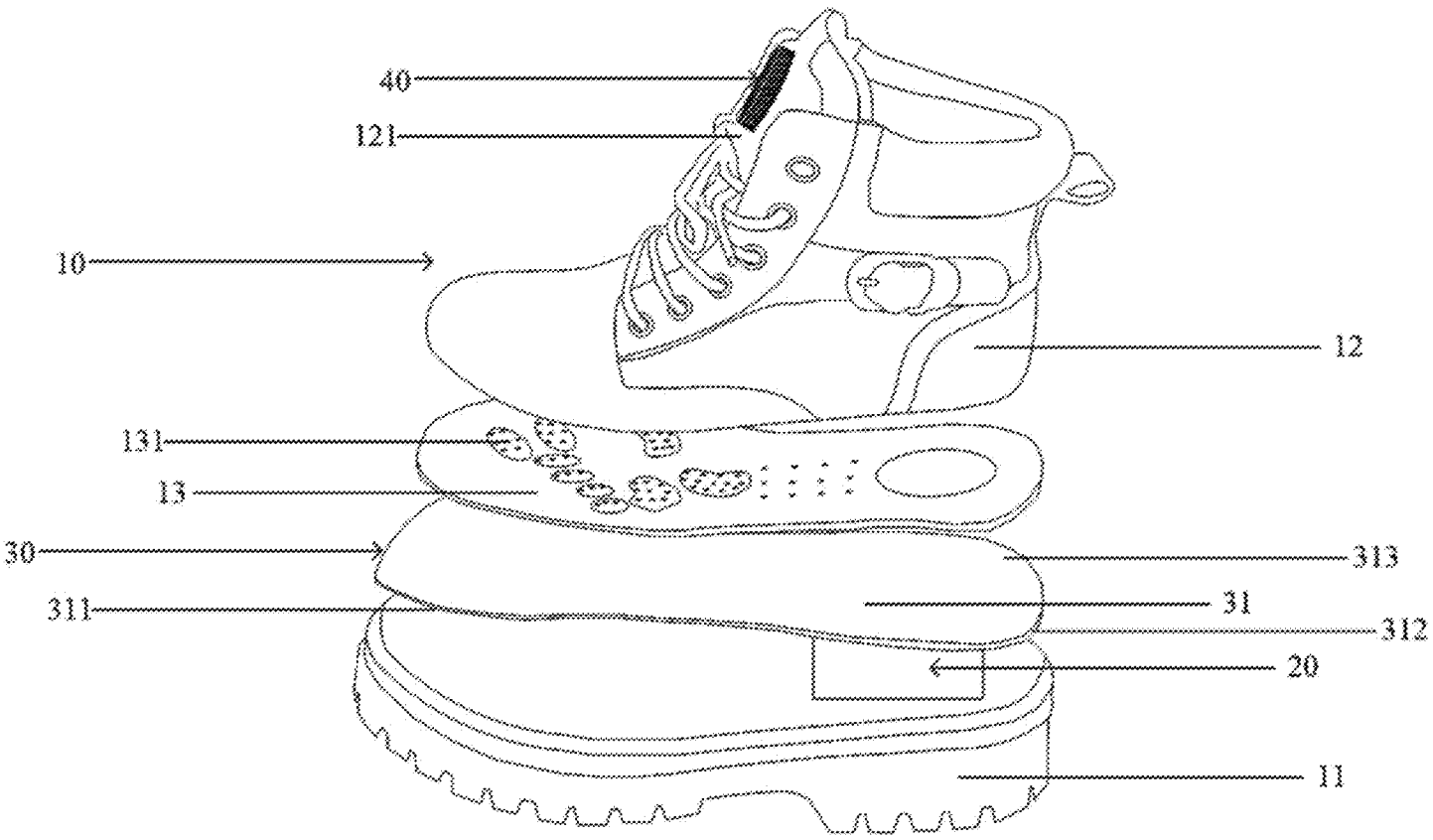
FIG. 2 is a schematic exploded view of a heating shoe according to an embodiment of the present invention.
Figure 3:
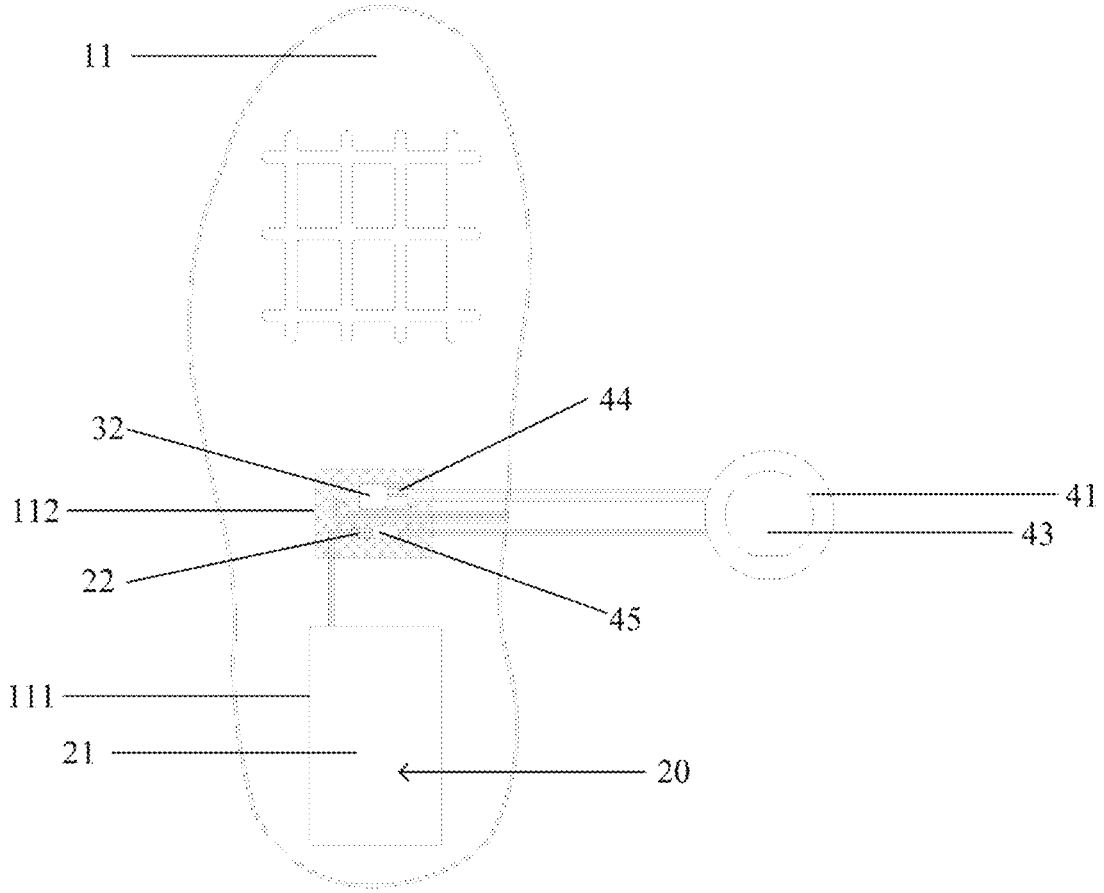
FIG. 3 is a schematic structural diagram of a sole of a heating shoe according to an embodiment of the present invention.
Figure 4:
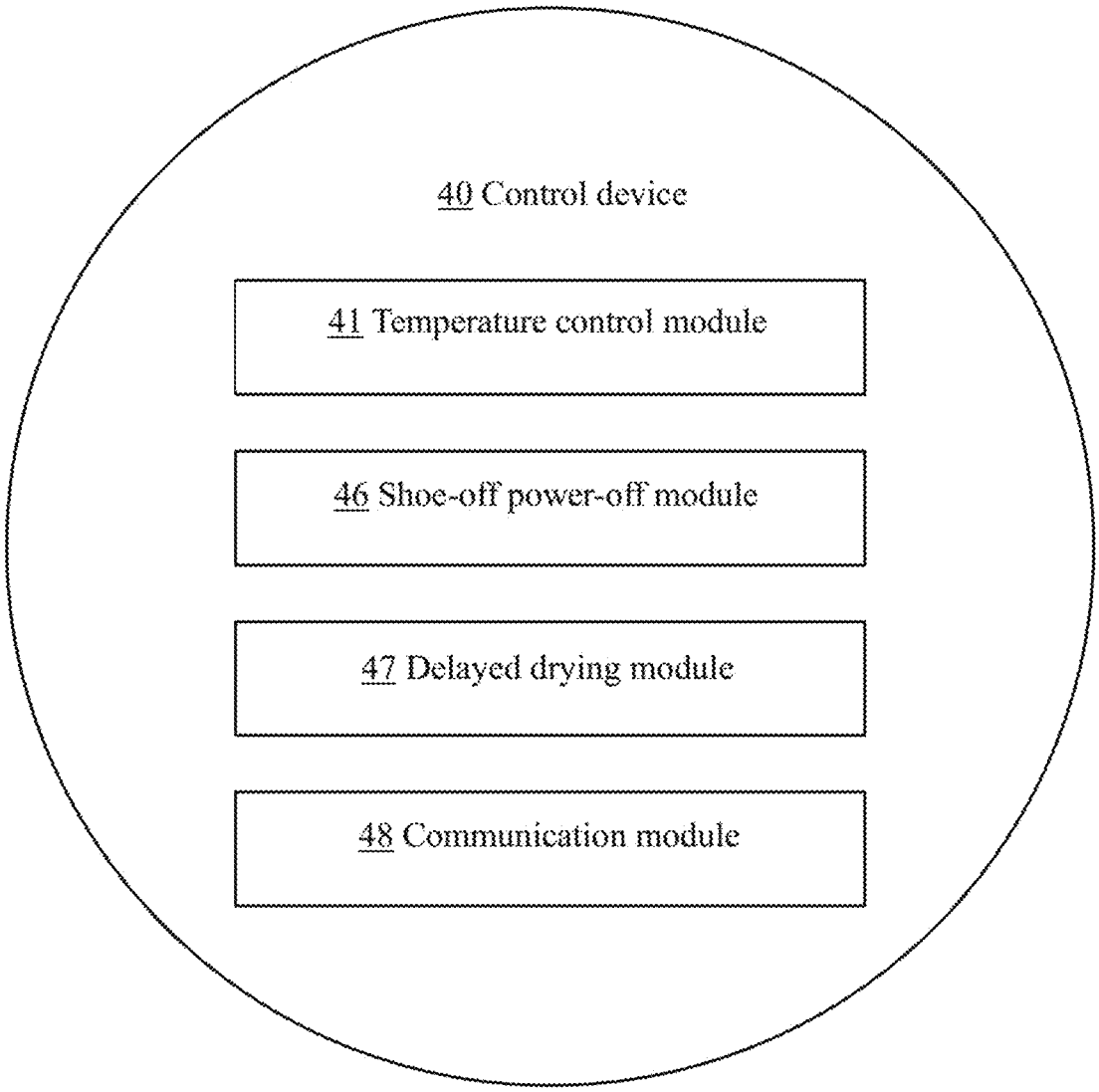
FIG. 4 is a schematic module diagram of a control device according to an embodiment of the present invention.

As shown in FIGS. 1-4, an embodiment of the present invention discloses a heating shoe 10, including a sole 11 and a vamp 12, where the vamp 12 is arranged on the sole 11; the heating shoe 10 further includes a power supply device 20, a heating device 30, and a control device 40, where an upper surface of the sole 11 is provided with several heating zones; the heating device 30 is electrically connected to the control device 40; the control device 40 is electrically connected to the power supply device 20; the control device 40 is mounted on an outer surface of the vamp 12; a heating module is arranged on the upper surface of the sole 11; the heating module includes a plurality of groups of heating elements 312; a control module independently controls each of the plurality of groups of heating elements 312; and each of the plurality of groups of heating elements 312 is arranged respectively corresponding to a different one of the heating zones.

By arranging the plurality of groups of heating elements 312 in the heating shoe 10 and arranging each of the plurality of groups of heating elements 312 respectively corresponding to a different one of the heating zones, temperature zoning can be realized and the control module independently controls each of the plurality of groups of heating elements 312 to enable a certain zone of the sole 11 that is required to be heated to generate heat separately or a certain zone to have a heating temperature different from those of other zones as required, which can save electricity and prolong the battery life while meeting more requirements. Furthermore, the control device 40 is arranged on the outer surface of the vamp 12, which is very convenient for a user to operate and use.

The heating device 30 includes a heating sheet 31 and a first terminal 32 connected to the heating sheet 31; the control module includes a second terminal 44 quickly detachably connected to the first terminal 32; the heating sheet 31 includes a fixed layer 311 and a waterproof layer 313; the heating elements 312 are arranged between the fixed layer 311 and the waterproof layer 313; the waterproof layer 313 is bonded to the fixed layer 311 through a waterproof adhesive; the heating sheet 31 covers the upper surface of the sole 11; the arrangement of the fixed layer 311 facilitates the mounting of a heating assembly; the fixed layer 311 has a relatively good bending-resistant effect, can provide relatively good support for the heating elements 312, and can effectively protect the heating elements 312; the waterproof layer 313 can effectively prevent the invasion of water vapor during use to effectively ensure the safe and efficient use of the heating device 30; the heating sheet 31 is configured to match the shape and size of the sole 11, cover the upper surface of the sole 11 during used, and use the first terminal 32 and the second terminal 44 for realizing quickly detachable connection to facilitate the replacement of different heating sheets 31; and a user can customize the heating sheet 31 with a different shape or capable of mounting the heating elements 312 in different zones as required to better meet different requirements, for example, a separately controlled heating assembly is mounted at a special acupuncture point on a foot.

The power supply device 20 includes a charging power supply 21 and a third terminal 22 connected to the charging power supply 21; the control module includes a fourth terminal 45 quickly detachably connected to the third terminal 22; a first groove 111 is formed at a heel position of the sole 11; the charging power supply 21 is arranged in the first groove 111; a protective shell encloses the charging power supply 21; the protective shell is configured to be a cuboid matching the first groove 111 and have a thickness less than or equal to the depth of the first groove 111; the heating sheet 31 covers the first groove 111 for shielding and protection; a rapidly detachable connection is realized by the third terminal 22 and the fourth terminal 45 to facilitate the replacement of new or different specifications of charging power supplies 21 so that the later maintenance cost of the heating shoe 10 can be further reduced; optionally, a second groove 112 is formed on the sole 11, the first terminal 32, the second terminal 44, the third terminal 22, and the fourth terminal 45 may be transversely mounted in the second groove 112 and fixed with glue, and a vacant part is filled to achieve a stronger fixation effect.

The charging power supply 21 includes a battery case and a lithium polymer battery; an electrolyte of the lithium polymer battery may use a solid or colloidal polyelectrolyte or an organic electrolyte so that the overall weight of the charging power supply 21 can be effectively reduced; furthermore, the size flexibility makes the heating shoe 10 lighter and more comfortable to wear; and a thimble and/or an induction coil for charging the lithium polymer battery are/is arranged on the battery case so that the heating shoe 10 can be charged through magnetic attraction or wireless charging while being stored in cooperation with the storage rack for wireless charging by placing the heating shoe 10 in a wireless charging induction area or in a magnetic attraction manner by cooperating with the thimble.

The control device 40 includes a control panel 41 and a temperature control module 42; the temperature control module 42 includes a temperature control circuit and a temperature control switch 43 arranged on the control panel 41; the temperature control circuit is electrically connected to the heating elements 312; the temperature control switch 43 independently controls the heating temperature of each of the plurality of groups of heating elements 312; the plurality of groups of heating elements 312 arranged in the heating shoe 10 can realize temperature zoning; and the temperature control switch 43 controls a certain section to separately generate heat or a certain zone to have a heating temperature different from those of other zones as required to save electricity and prolong the battery life while meeting more requirements.

The control device 40 includes a shoe-off power-off module 46; and the shoe-off power-off module 46 includes a sensor for sensing whether a foot is removed from a shoe cavity of the heating shoe 10, and a power-off control circuit cooperating with the sensor, and has a function of automatic power-off when the shoe is taken off, thereby preventing the battery from being exhausted when a user forgets to turn the power off.

The control device 40 includes a delayed drying module 47; the delayed drying module 47 includes a drying switch and a delayed drying circuit cooperating with the sensor; the drying switch is arranged on the control panel 41 and has a function of delayed power-off and drying; after mode adjustment, the function of delayed power-off and drying will be activated for the shoe to dry the water vapor in the shoe so that the shoe is kept dry; and after the shoe is adjusted to the drying mode, the heating amount of the shoe will be larger than that during heating so that rapid drying is achieved.

The heating shoe 10 further includes an insole 13 and a hot air device; the vamp 12 includes a tongue 121; the control panel 41 and the hot air device are detachably arranged on the tongue 121, and a connecting buckle of the hot air device is arranged on the tongue 121 so that the hot air device can be arranged outside, and hot air can be blown into the heating shoe 10 to rapidly warm a foot therein; and the insole 13 is correspondingly arranged on the heating sheet 31, and the insole 13 is provided with several vent holes 131 corresponding to acupuncture points on a foot sole.

Each of the heating elements 312 includes a heating wire made of stainless steel fiber, and the heating wire made of stainless steel fiber can further improve the bending performance of the heating wire and prolong the service life of the heating sheet 31.

Another embodiment of the present invention provides a heating shoe 10 set (not shown), including two of the above-described heating shoes 10; the control device 40 includes a communication module 48; the communication module 48 includes any one of an infrared unit, a Bluetooth unit, a Wi-Fi unit, a radio frequency identification unit, and a 3G/4G/5G mobile communication unit, or a combination thereof; the two heating shoes 10 perform wireless communication through the communication module and have independent control devices 40; the two heating shoes 10 are interconnected in a wireless manner so that information of the two heating shoes 10 is synchronized, for example, a pair of shoes is set to be in the third position originally, if one of the shoes is adjusted to be in the second position, the other shoe will also be synchronized to the second position through wireless communication; the heating shoe 10 set further includes a charging shoe rack; the charging shoe rack includes a charging base and a storage rack; when the heating shoe 10 is placed on the storage rack, the charging base cooperates with the power supply device 20 for charging so that the heating shoe 10 can be charged through magnetic attraction or wireless charging in cooperation with the storage rack for wireless charging, realizing that the heating shoe 10 is charged while being stored by placing the heating shoe 10 in a wireless charging induction area or in a magnetic attraction manner by cooperating with the thimble.

The foregoing further describes the present invention in detail in conjunction with preferred embodiments, and it cannot be concluded that the implementation of the present invention is limited thereto. Those of ordinary skill in the art can make various inferences or substitutions without departing from the concept of the present invention, and all such inferences and variations should be deemed to fall within the protection scope of the present invention.

What is claimed is:

1. A heating shoe, comprising a sole and a vamp, wherein the vamp is arranged on the sole; the heating shoe further comprises a power supply device, a heating device, and a control device; an upper surface of the sole is provided with several heating zones; the heating device is electrically connected to the control device; and the control device is electrically connected to the power supply device;

wherein the control device comprises a control panel and a temperature control module; the temperature control module comprises a temperature control circuit and a temperature control switch arranged on the control panel; the temperature control circuit is electrically connected to heating elements; and the temperature control switch independently controls the heating temperature of each group of the heating elements;

wherein the heating shoe further comprises an insole and a hot air device, wherein the vamp comprises a tongue; the control panel and the hot air device are detachably arranged on the tongue; and the insole is provided with several vent holes corresponding to acupuncture points on a foot sole.

2. The heating shoe according to claim 1, wherein the heating device comprises a heating sheet and a first terminal connected to the heating sheet; a control module comprises a second terminal quickly-detachably connected to the first terminal; the heating sheet comprises a fixed layer and a waterproof layer; the heating elements are arranged between the fixed layer and the waterproof layer; and the heating sheet covers that upper surface of the sole.

3. The heating shoe according to claim 2, wherein the power supply device comprises a charging power supply and a third terminal connected to the charging power supply; the control module comprises a fourth terminal quickly detachably connected to the third terminal; a first groove is formed at a heel position of the sole; and the charging power supply is arranged in the first groove.

4. The heating shoe according to claim 3, wherein the charging power supply comprises a battery case and a lithium polymer battery.

5. The heating shoe according to claim 1, wherein the control device comprises a shoe-off power-off module; and the shoe-off power-off module comprises a sensor for sensing whether a foot is removed from a shoe cavity of the heating shoe, and a power-off control circuit cooperating with the sensor.

6. The heating shoe according to claim 5, wherein the control device comprises a delayed drying module; the delayed drying module comprises a drying switch and a delayed drying circuit cooperating with the sensor; and the drying switch is arranged on the control panel; wherein the drying switch is configured to communicate with the hot air device.

7. The heating shoe according to claim 1, wherein the heating elements comprise a heating wire made of stainless steel fiber.

8. A heating shoe set, comprising two of the heating shoes according to claim 1, wherein the control device comprises a communication module; the communication module comprises any one of an infrared unit, a Bluetooth unit, a Wi-Fi unit, a radio frequency identification unit, and a 3G/4G/5G mobile communication unit, or a combination thereof; the two heating shoes perform wireless communication through the communication module and have independent control device so that information of the two heating shoes is synchronize.

* * * * *